United States Patent [19]

Grech

[11] Patent Number: 4,681,084

[45] Date of Patent: Jul. 21, 1987

[54] BURNER CONTROL SYSTEM

[75] Inventor: Leonard Grech, Capistrano Beach, Calif.

[73] Assignee: George Catsouras, Laguna Niguel, Calif. ; a part interest

[21] Appl. No.: 913,073

[22] Filed: Sep. 29, 1986

Related U.S. Application Data

[63] Continuation-in-part of Ser. No. 738,253, May 28, 1985, abandoned.

[51] Int. Cl.[4] ..... F24C 3/12

[52] U.S. Cl. ..... 126/52; 126/39 E

[58] Field of Search ..... 126/39 E, 52, 24; 431/88; 137/599

[56] References Cited

U.S. PATENT DOCUMENTS 1,312,655 8/1919 Whalen ..... 126/52

2,146,660 2/1939 Schwartz ..... 431/256

2,612,901 10/1952 Milano ..... 137/78.2

2,667,605 1/1954 Massier ..... 431/256 x 2,781,030 2/1957 Sherman ..... 126/52

FOREIGN PATENT DOCUMENTS 444070 1/1949 Italy ..... 126/52

*Primary Examiner*—Samuel Scott

*Assistant Examiner*—Allen J. Flanigan

*Attorney, Agent, or Firm*—Gordon L. Peterson

[57] ABSTRACT

A gas stove including at least one burner, a gas supply conduit for supplying gas to the burner, a solenoid valve in the gas supply conduit, a sensor for detecting the presence or absence of a utensil on a burner and a control circuit responsive to the sensor to open the solenoid valve when the utensil is on the burner and to slose the solenoid valve when the utensil is off the burner.

18 Claims, 3 Drawing Figures

BURNER CONTROL SYSTEM

This application is a continuation-in-part of application Ser. No. 738,253 filed on May 28, 1985, now abandoned, and entitled Burner Control System.

BACKGROUND OF THE INVENTION

Gas stoves are commonly used in commercial and domestic kitchens. One problem with the use of gas stoves in restaurants is that the chefs often leave the burners burning when they are not in use, and this wastes fuel. Also, gas stoves used domestically present a hazard when the main gas valve is left open and the pilot light is out.

In an effort to solve this problem, various mechanical devices and linkages have been proposed for shutting off the supply of gas to the burner when a utensil is not on the burner. Unfortunately, many of the mechanical devices are relatively complex and are subject to sticking or fouling when contaminated by greases and other cooking materials. Also, it is difficult or impossible to retrofit a mechanical mechanism of this type onto an existing burner.

Chen U.S. Pat. No. 4,391,265 discloses a gas range in which a utensil actuates switches to control a motor. The motor can move the gas valve between high flame and low flame positions. This does not solve the problem of excessive gas utilization or the danger imposed by an unlit pilot light.

SUMMARY OF THE INVENTION

The present invention solves these problems by providing a simple, inexpensive and reliable solenoid valve in the gas supply conduit to the burner. The solenoid valve is controlled, at least in part, by the presence or absence of a utensil on the burner. The solenoid valve has an open position in which it permits gas flow therethrough to the burner, and a second position in which it reduces gas flow therethrough to the burner. If the solenoid valve is of the on-off type, it substantially prevents gas flow therethrough in the off position.

The presence of a utensil on the burner is sensed by sensing means which provides a first signal when a utensil is on the burner and a second signal when no utensil is on the burner. Circuit means is responsive to the first signal to move the solenoid valve to the open position so that gas can be supplied to the burner and is responsive to the second signal to move the solenoid valve to the closed position so that gas flow through the solenoid valve to the burner is substantially prevented. For example, the solenoid valve may be biased closed, and in this event, the circuit means opens the valve in response to the first signal and moves the valve in response to the second signal to the closed position by allowing the biasing means of the valve to close the valve.

The sensing means can be of any type which can detect the presence or absence of the utensil on the burner. Although this can be accomplished optically with a light source and photocell, preferably the sensing means includes an actuator rod extending from the burner which is engageable and movable by a utensil on the burner.

The motion imparted to the actuator rod by the utensil can be used in various different ways to provide the first and second signals to which the circuit means responds. For example, in a preferred embodiment, the sensing means also includes a switch having first and second states for providing the first and second signals, respectively. The switch is advantageously normally in one of the states and is moved to the other of the states by the actuator rod.

The switch is preferably a microswitch for controlling electrical energy. However, in a broader sense, it may be any device which can switch between first and second states in response to movement of the actuator rod. Thus, the switch may be, for example, optical, a mechanical motion transmitting device, etc.

At times, it may be necessary or desirable to only temporarily remove the utensil from the burner. When this occurs, it is not desired to extinguish the burner flame. Another feature of this invention is the provision of time delay means which prevents closure of the solenoid valve for a predetermined time following removal of the utensil from the burner. This allows the utensil to be temporarily removed from the burner without extinguishing or reducing the flame.

It is preferred to locate various portions of the burner control system of this invention below the burner being controlled. To reduce or prevent contamination of the components of the burner control system, including the switch, this invention provides a shield assembly interposed between the burner and the component or components to be protected.

The shield assembly may include a shield mounted on the actuator rod for movement therewith and interposed between the switch and the burner, and mounting means beneath the shield and slidably cooperating with the actuator rod for mounting the actuator rod for movement. With this construction, the shield can shield the switch and the mounting means from grease and cooking materials that may fall through the burner. If the mounting means for the actuator rod were not protected from grease and cooking materials, it could jam in the mounting means. The shield is also radially unconfined in its movement so that it cannot be the cause of jamming of the actuator rod and the shield.

The shield assembly may also include another shield interposed between the burner and the switch for shielding the switch from the burner. This shield may also include the mounting means for mounting the actuator rod for movement. The mounting means can advantageously be in the form of a bearing, and the actuator rod is preferably slidably received in the bearing.

Although only one of the shields is required, the shield assembly preferably includes both of the above-described shields. Although the shields can be of various different configurations, a generally dome or hemispherical configuration is preferred.

This invention also provides for the adjustment of the effective length of the actuator rod.

This invention also provides a bypass conduit around the solenoid valve and a manually operable valve in the bypass conduit. This enables the burner to be used during power outages.

The solenoid valve controls the main flow of gas to the burner, and when an electrical igniter is used, it may also control the flow of pilot gas to the igniter. Preferably, when an electric igniter is used, the igniter is automatically started when a utensil is placed on the burner. More specifically, the igniter responds to the first signal from the switch to ignite the gas at the burner, and the opening of the solenoid valve also provides whatever gas is required by the electric igniter.

DESCRIPTION OF THE PREFERRED EMBODIMENT

Figure 1:
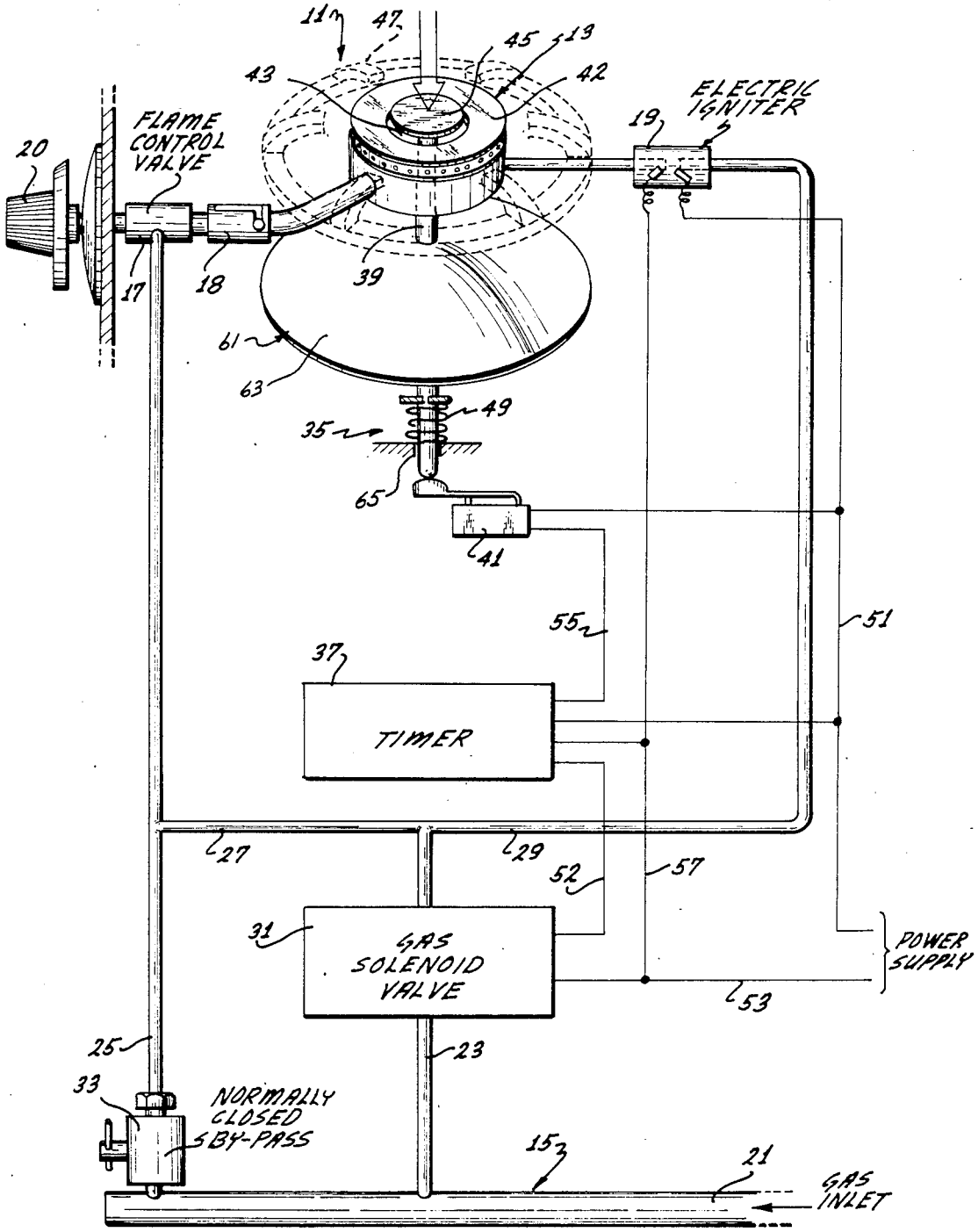
FIG. 1 is a schematic representation of a stove utilizing one form of burner control system constructed in accordance with the teachings of this invention. The burner and shield are depicted isometrically.

The drawing shows a stove 11 which generally comprises a burner 13, a gas supply conduit 15, a manually operable gas valve 17, an air adjuster 18, an electric igniter 19, and a control knob 20 for the valve 17. All of these components may be conventional, and any number of the burners 13 and igniters 19 can be provided.

The gas supply conduit 15 includes a header 21, lateral conduits 23 and 25 leading from the header 21 and coupled by a connecting conduit 27, and a pilot conduit 29. A normally closed solenoid valve 31, which may be of conventional construction, is provided in the lateral conduit 23 intermediate the header 21 and the connecting conduit 27, and a manually operable bypass valve 33 is provided in the lateral conduit 25 in parallel with the solenoid valve 31. Normally the bypass valve 33 is closed so that the gas from the header 21 must flow through the solenoid valve 31 and the valve 17 to the burner 13. Similarly, the normal flow for the pilot gas to the igniter 19 is through the solenoid valve 31 and the pilot conduit 29.

The solenoid valve 31 is controlled by sensing means 35 and a timer 37. Although the sensing means can take different forms, in the embodiment illustrated, it includes an actuator rod 39 and a normally open switch 41. The burner 13 is conventional and includes an annular gas diffuser or burner element 42, and the actuator rod extends into a central opening 43 of the burner element 42. The actuator rod 39, in the form illustrated, is an elongated rod-like member which includes a contact plate 45 at its upper end which lies just above a utensil support plane or surface formed by the conventional grid 47 of the burner 13. Accordingly, if a utensil is placed on the grid 47 of the burner 13, it will engage the plate 45 and urge the actuator rod 39 downwardly against the biasing action of a spring 49 which biases the actuator rod 39 upwardly. The periphery of the contact plate 45 is spaced radially inwardly from the central opening a significant distance so that small quantities of food, grease or the like will not jam the actuator rod 39.

The switch 41, which may be a microswitch, has open and closed positions, and as such, is a two-state device. In the embodiment illustrated, the microswitch 41 is open when there is no utensil on the burner 13 and the actuator rod 39 is biased upwardly, and it is closed by the actuator rod when a utensil is placed on the burner 13 to force the rod 39 downwardly against the biasing action of the spring 49.

The switch 41 and the electric igniter 19 are coupled to one lead 51 from a suitable power supply. The switch 41 is also coupled through the timer 37 and a conductor 52 to the solenoid valve 31. A second lead 53 leads from the power supply to the solenoid valve 31.

The timer 37 is coupled by a lead 57 to the lead 53. The timer 37, which is coupled by leads 55 and 52 to the switch 41 and solenoid valve 31, respectively, completes the circuit from the switch 41 to the solenoid valve 31 instantaneously upon closure of the switch 41. However, when the switch 41 is opened, the timer 37 breaks the circuit to the solenoid valve 31 after a predetermined time delay. The timer 37 is reset each time the switch 41 is closed. Timers of this type are conventional, and may be obtained, for example, from Eagle Signal Industrial Controls of Davenport, Iowa.

The time delay provided by the timer 37 should be sufficient to allow the utensil to be temporarily removed from the burner for the usual purposes associated with cooking. For example, a delay of from several seconds up to a minute would ordinarily be sufficient.

With no utensil on the burner 13, the spring 49 urges the actuator rod 39 upwardly, and the switch 41 is open to interrupt the circuit to the solenoid valve 31 so that the solenoid valve remains closed. The bypass valve 33 is normally closed, and the gas valve 17 is similarly normally closed.

When it is desired to use the stove 11, the manual valve 17 is opened to the desired amount and the utensil is placed on the burner 13. The utensil depresses the actuator rod 39 to close the switch 41 to complete the circuit through the timer 37 to the solenoid valve 31. This opens the solenoid valve 31 so that gas can flow through the connecting conduit 23 and the lateral conduit 25 to the burner and also through the pilot conduit 29 to the electric igniter 19. The igniter 19, in the embodiment illustrated, is coupled to be operated whenever the solenoid valve 31 is open, i.e., whenever the electric power is on. Accordingly, the igniter 19 ignites the gas at the burner 13.

If the utensil is removed from the burner 13, the spring 49 forces the actuator rod 39 upwardly so that the switch 41 returns to its normally open condition. However, the timer 37 maintains the circuit to the solenoid valve 31 closed for the preset time delay. If, during this time delay, the utensil is placed back on the burner 13, the switch 41 is closed by the actuator rod 39, and the timer 37 is reset so that burner operation continues in the normal manner. However, if the utensil is not returned to the burner 13 within the preset time delay, the timer times out and opens the circuit to the solenoid valve 31 and to the igniter 19. This enables the solenoid valve 31 to return to its normally closed position, whereupon, gas flow to the igniter and the burner terminate.

The solenoid valve 31 also functions as a safety valve in the event that the manual gas valve 17 is inadvertently opened. In this event, the solenoid valve 31 would ordinarily prevent gas leakage through the burner 13. The bypass valve 33 can be opened to permit operation of the stove 11 in a conventional manner whenever desired, such as in case of an electrical power outage.

FIG. 1 also shows a shield assembly 61 comprising a single dome-shaped shield 63 coupled to the actuator rod 39 for movement therewith. The shield 63 is interposed between the burner 13 and the switch 41 for shielding the switch from the burner. The spring 49 also lies below the shield 63 and is protected thereby.

The actuator rod 39 is mounted for vertical reciprocating movement by mounting means in the form of a centrally located bearing 65 coupled to suitable fixed structure (not shown). The bearing 65 is beneath the shield 63 and receives the actuator rod 39 so that confronting sliding surfaces of the actuator rod and bearing are protected from grease and cooking materials from the burner 13 by the shield 63. The shield 63 protects the spring 49, the bearing 65 and the switch 41 in both the upper and lower positions of the actuator rod.

Figure 2:
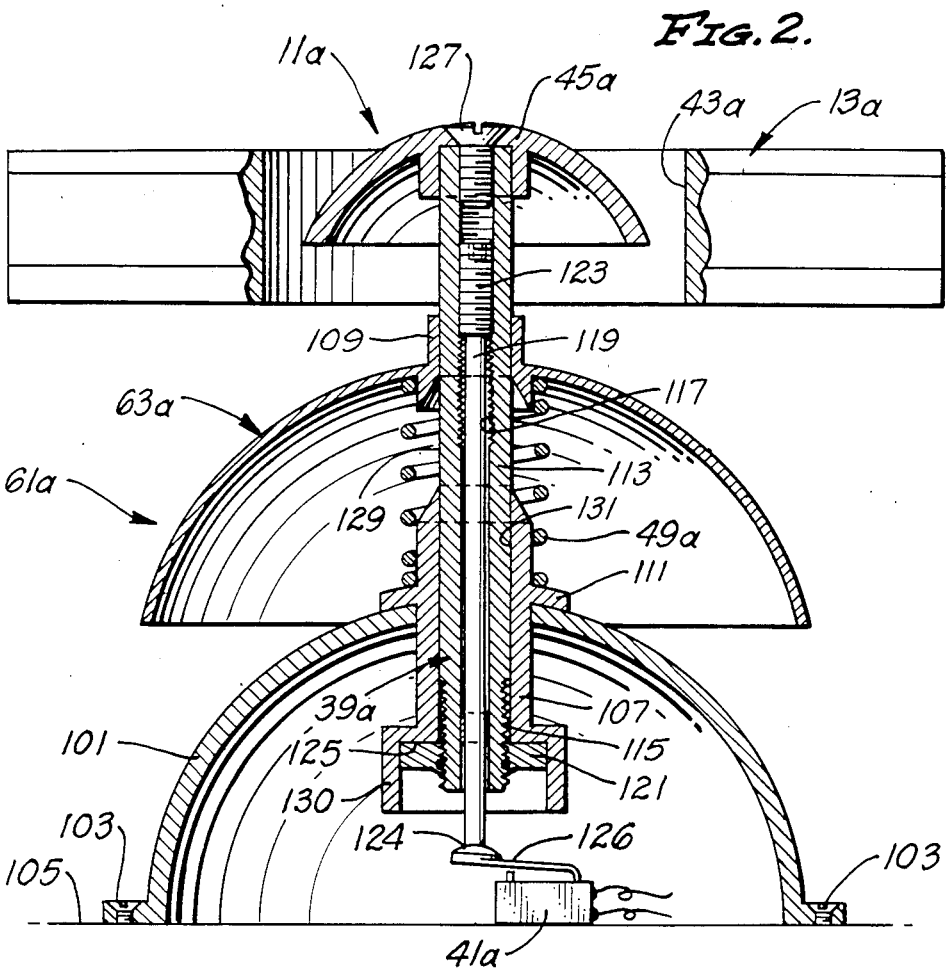
FIG. 2 is an enlarged sectional view illustrating a modified form of burner control system constructed in accordance with the teachings of this invention.

FIG. 2 shows a stove 11*a* which is identical to the stove 11 in all respects not shown or described herein. Portions of the stove 11*a* corresponding to portions of the stove 11 are designated by corresponding reference numerals followed by the letter "a."

The stove 11*a* is identical to the stove 11, except for the shield assembly 61*a* and the actuator rod 39*a*. Generally, the shield assembly 61*a* comprises an additional dome-shaped shield 101, and the actuator rod 39*a* is of different construction.

More specifically, the shield 101 is suitably attached as by fasteners 103 to suitable supporting structure 105. The shield 101 forms a completely enclosed hemispherical space and has an elongated sleeve bearing 107 suitably attached thereto and projecting in a polar direction through the upper end of the shield.

The shield 63*a* is also of dome-shaped configuration and is almost hemispherical. In this embodiment, the shield 63*a* is of approximately the same diameter as the shield 101, and it has a collar 109 for fixedly attaching the shield to the actuator rod 39*a*. The spring 49*a* acts between a flange 111 on the bearing 107 and the shield 63*a* to urge the shield 63*a* and the actuator rod 39*a* upwardly.

The actuator rod 39*a* includes an elongated tube 113 having external threads 115 on a lower end portion and internal screw threads 117 on an upper region thereof. The actuator rod 39*a* also includes a stem 119 and a self-locking nut 121. The upper end of the stem 119 has external threads 123 cooperable with the internal threads 117 of the tube 113 to attach the stem 119 to the tube, and a lower end 124 of the stem is engageable with an actuating arm 126 of the switch. The locking nut 121 is attached to the external threads 115 of the tube 113 and bears against a lower end 125 of the bearing 107.

The plate 45*a* in this embodiment is generally dome-shaped and is attached by a screw 127 to the upper end of the tube 113. With this construction, the plate 45*a*, the tube 113, the stem 119 and the nut 121 move together in both directions along a vertical path and are urged upwardly by the biasing action of the spring 49*a*. The uppermost position of the actuator rod 39*a* is defined by the engagement of the nut 121 against the end 125 of the bearing 107. The effective length of the actuator rod 39*a* can be adjusted by turning of the tube 113 to advance or retract the tube in relation to the nut 121 and/or by advancing or retracting the stem 119 in the tube 113. The tube 113 includes a socket 130 which receives the nut 121 and holds the latter against rotation so that the tube can be rotated from above to accomplish the effective length adjustment.

In use, the actuator rod 39*a* extends through the shield 101 and is movable with respect to the shield 101 to move the switch 41*a* between its open and closed states. The switch 41*a* functions in the same manner as the switch 41 as described in connection with FIG. 1. The shield 101 shields the switch 41*a* from the burner 13*a*, and the shield 63*a* moves with the actuator rod 39*a*. The shield 63*a* shields regions of the actuator rod 39*a* and regions of the first shield 101. More specifically, the shield 63*a* shields the confronting sliding surfaces 129 and 131 of the actuator rod 39*a* and of the bearing 107. If these surfaces were not shielded, grease and cooking materials could get between them to jam the actuator rod 39*a* in the bearing 107. In all other respects, the embodiment of FIG. 2 operates as described above in connection with the embodiment of FIG. 1. The screw 127 protects the threads 117 and 123 from grease and cooking materials from the burner 13*a*.

Figure 3:
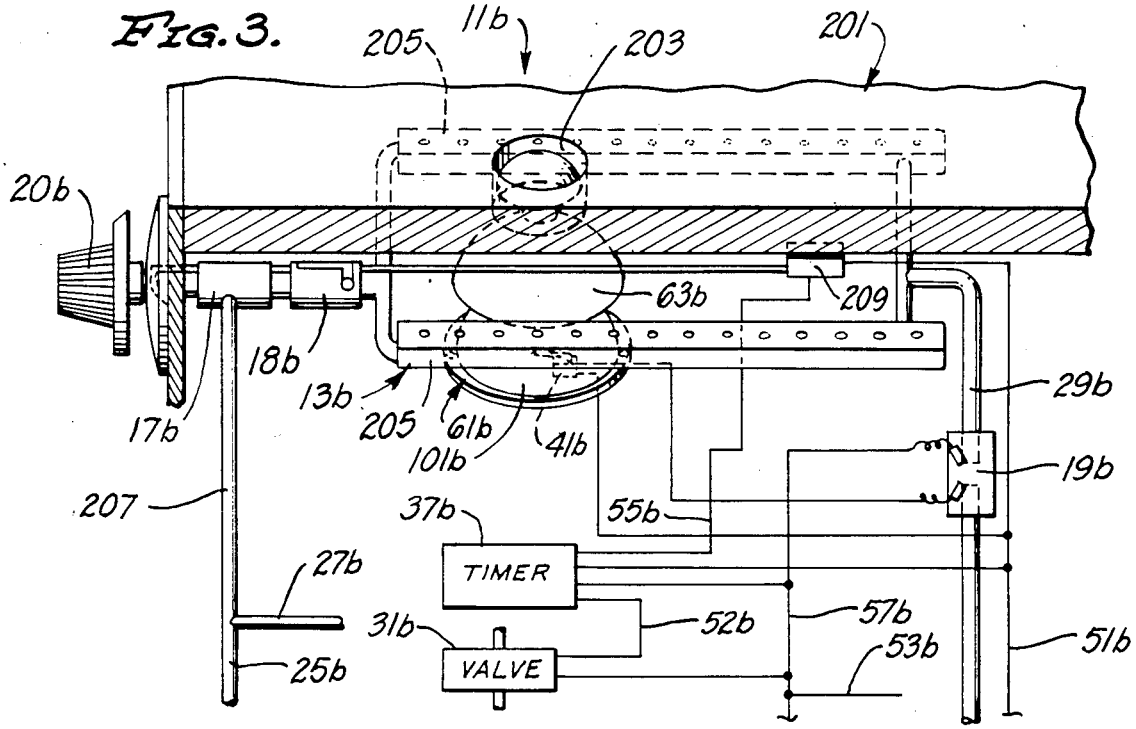
FIG. 3 is a partially schematic sectional view illustrating the burner control system of this invention applied to a heavy plate cooking unit.

FIG. 3 shows a stove 11*b* which is identical to the stove 11 in all respects not shown or described herein. Portions of the stove 11*b* corresponding to portions of the stove 11 are identified by corresponding reference numerals followed by the letter "b."

The primary difference between the stove 11*b* and the stove 11 is that the former has a large metal plate 201 which is heated by a plurality of burners 13*b* (only one being shown in FIG. 3). Each of the burners 13*b* has an associated switch 41*b* and an associated circular opening 203 in the plate 201. Each of the burners 13*b* may comprise parallel burner bars 205 coupled to the gas solenoid valve (not shown in FIG. 3) by conduit 207 and the connecting conduit 27*b* and to the bypass valve (not shown in FIG. 3) by the conduits 207 and 25*b*.

The shield assembly 61*b* may be identical to the shield assembly 61*a* (FIG. 2) or 61 (FIG. 1). One of the shield assemblies 61*b* can be provided for each of the burners 13*b*, or if a plurality of the burners 13*b* are controlled by a single switch 41*b*, then one of the shield assemblies 61*b* is provided for each of the switches 41*b* for such plurality of burners.

The circuit means for the burner 13*b* may be identical to the circuit of FIG. 1, except for the wiring of the igniter 19*b* and for the presence of a thermostatic switch 209. The thermostatic switch 209 is coupled to the lead 51*b*, which leads to the power supply (not shown in FIG. 3) and to the lead 55*b* which leads to the other side of the power supply through the timer 37*b*. The thermostatic switch 209 is, therefore, coupled in parallel with the switch 41*b* so that, when either of these switches is closed, the gas solenoid valve (not shown in FIG. 3) will be open to supply gas to the burner 13*b*.

The igniter 19*b* is coupled to the leads 55*b* and 57*b* rather than to the leads 51 and 57 as in the embodiment of FIG. 1. By coupling the igniter 19*b* in this fashion, it will be supplied with electrical power only when at least one of the switches 41*b* and 209 is closed.

The stove 11*b* operates in the same manner as the stove 11 of FIG. 1, except that the burners 13*b* may be turned on by closure of either the thermostatic switch 209 or the switch 41*b*, and the igniter 19*b* is supplied with power only when at least one of these two switches is closed. In addition, the stove 11*b* may be provided with multiple burners 13*b* controlled by a single control system and one or more of the systems shown in FIG. 3 may be provided for a single plate 201, if desired. Of course, the igniter 19 of FIG. 1 may be coupled into the circuit of FIG. 1 as shown in FIG. 3, if desired.

In each of the specifically described embodiments, it is assumed that the gas solenoid valve 31 an on-off valve. However, if desired, the valve 31 may have two or more on positions with different volumes of gas being provided in each of the on positions. This can be provided, for example, by providing a bleed passage through the valve 31 such that some gas will always flow through it.

Although an exemplary embodiment of the invention has been shown and described, many changes, modifications and substitutions may be made by one having ordinary skill in the art without necessarily departing from the spirit and scope of this invention.

I claim:

1. A burner control system for use with a gas stove having at least one burner and a gas supply conduit for supplying gas to the burner, said burner control system comprising:

a solenoid valve in said conduit for controlling the main flow of gas to the burner, said solenoid valve having an open position in which it permits gas flow therethrough to the burner and a second position in which it reduces gas flow therethrough the burner;

sensing means for providing a first signal when a utensil is on the burner and a second signal when no utensil is on the burner;

said sensing means including a switch having first and second states for providing said first and second signals, respectively, and an actuator rod extending between the burner and the switch, said switch being normally in said second state and said actuator rod being engageable and movable by a utensil on the burner to move said switch to said first state to provide said first signal;

circuit means responsive to the first signal to move the solenoid valve to the open position whereby gas can be supplied to the burner and responsive to said second signal to move the solenoid valve to the second position whereby gas flow through the solenoid valve to the burner is reduced;

said switch being below said burner;

a shield mounted on the actuator rod for movement therewith and interposed between the switch and the burner; and mounting means located entirely beneath said shield and slidably cooperating with the actuator rod for mounting the actuator rod for movement.

2. A burner control system as defined in claim 1 including means for adjusting the effective length of the actuator rod.

3. A burner control system as defined in claim 1 including means for resiliently biasing the shield and actuator rod toward a position in which the switch is in said second state.

4. A burner control system as defined in claim 1 wherein said mounting means includes another shield for protecting the switch.

5. A burner control system as defined in claim 1 wherein said mounting means includes a centrally located bearing beneath said shield which receives the actuator rod.

6. A burner control system as defined in claim 1 wherein said circuit means includes time delay means responsive to said second signal for moving the solenoid valve to said closed position a predetermined time after the utensil is removed from the burner.

7. A burner control system as defined in claim 1 including a bypass conduit for bypassing said solenoid valve and a manually operable normally closed valve in said bypass conduit.

8. A burner control system as defined in claim 1 including means responsive to the first signal to ignite the gas at the burner.

9. A burner control system for use with a gas stove having at least one burner and a gas supply conduit for supplying gas to the burner, said burner control system comprising:

a solenoid valve in said conduit for controlling the main flow of gas to the burner, said solenoid valve having an open position in which it permits gas flow therethrough to the burner and a second position in which it reduces gas flow therethrough the burner;

sensing means for providing a first signal when a utensil is on the burner and a second signal when no utensil is on the burner;

said sensing means including a switch having first and second states for providing said first and second signals, respectively, and an actuator rod extending between the burner and the switch, said switch being normally in said second state and said actuator rod being engageable and movable by a utensil on the burner to move said switch to said first state to provide said first signal;

circuit means responsive to the first signal to move the solenoid valve to the open position whereby gas can be supplied to the burner and responsive to said second signal to move the solenoid valve to the second position whereby gas flow through the solenoid valve to the burner is reduced;

said switch being below said burner;

a shield assembly including a first shield interposed between the burner and the switch for shielding the switch from the burner;

said actuator rod extending through said first shield and being movable with respect to the first shield to move said switch; and said shield assembly including a second shield interposed between the burner and the first shield for shielding regions of the actuator rod and the first shield.

10. A burner control system as defined in claim 9 wherein at least one of said shields is generally dome shaped.

11. A burner control system as defined in claim 9 wherein said regions of the actuator rod and the first shield include confronting sliding surfaces of the actuator rod and the first shield.

12. A burner control system as defined in claim 9 wherein the first shield includes a bearing and said actuator rod is slidably received in said bearing, said regions of the actuator rod and the first shield include cooperating sliding surfaces of the bearing and the actuator rod, and said second shield is mounted on the actuator rod for movement therewith.

13. A gas stove comprising:

at least one burner;

a gas supply conduit for supplying gas to the burner;

a manually operable gas valve for controlling the flow of gas through the supply conduit to the burner;

a solenoid valve for controlling the flow of gas to the burner, said solenoid valve having an open position in which it permits gas flow therethrough to the burner and a closed position in which it substantially prevents gas flow therethrough to the burner;

sensing means for providing a first signal when a utensil is on the burner and a second signal when no utensil is on the burner;

circuit means responsive to said first signal to move the solenoid valve to the open position whereby gas can be supplied to the burner and responsive to said second signal to move the solenoid valve to the closed position whereby gas flow through the solenoid valve to the burner is substantially prevented; and time delay means responsive to said second signal for moving the solenoid valve to said closed position a predetermined time after the utensil is removed from the burner.

14. A gas stove as defined in claim 13 including a bypass conduit for bypassing said solenoid valve and a manually operable valve in said bypass conduit.

15. A gas stove as defined in claim 13 including means responsive to the first signal to ignite the gas at the burner.

16. A gas stove as defined in claim 13 wherein said sensing means includes a switch having first and second states for providing said first and second signals, respectively, and an actuator rod extending between the burner and the switch, said switch normally is in said second state and said actuator rod is engageable and movable by a utensil on the burner to move said switch to said first state to provide said first signal.

17. A gas stove as defined in claim 13 wherein said gas supply conduit includes a pilot gas conduit coupled to receive gas from said solenoid valve and said stove includes an electric igniter coupled to said pilot gas conduit and means responsive to said first signal for operating said electric igniter.

18. A burner control system for use with a gas stove having at least one burner and a gas supply conduit for supplying gas to the burner, said burner control system comprising:

a solenoid valve in said conduit for controlling the main flow of gas to the burner, said solenoid valve having an open position in which it permits gas flow therethrough to the burner and a second position in which it reduces gas flow therethrough the burner;

sensing means for providing a first signal when a utensil is on the burner and a second signal when no utensil is on the burner;

said sensing means including a switch having first and second states for providing said first and second signals, respectively, and an actuator rod extending between the burner and the switch, said switch being normally in said second state and said actuator rod being engageable and movable by a utensil on the burner to move said switch to said first state to provide said first signal;

circuit means responsive to the first signal to move the solenoid valve to the open position whereby gas can be supplied to the burner and responsive to said second signal to move the solenoid valve to the second position whereby gas flow through the solenoid valve to the burner is reduced; and said circuit means including time delay means responsive to said second signal for moving the solenoid valve to said second position a predetermined time after the utensil is removed from the burner.

* * * * *